US011047259B2

(12) United States Patent
Bunel et al.

(10) Patent No.: US 11,047,259 B2
(45) Date of Patent: Jun. 29, 2021

(54) DEVICE FOR COOLING A TURBOMACHINE CASING

(71) Applicant: SAFRAN AIRCRAFT ENGINES, Paris (FR)

(72) Inventors: Jacques Marcel Arthur Bunel, Moissy-Cramayel (FR); Etienne Gérard Joseph Canelle, Moissy-Cramayel (FR); Emeric Christian Amaury D'Herbigny, Moissy-Cramayel (FR); Pierrick Bernard Jean, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 93 days.

(21) Appl. No.: 16/449,573

(22) Filed: Jun. 24, 2019

(65) Prior Publication Data

US 2019/0390569 A1 Dec. 26, 2019

(30) Foreign Application Priority Data

Jun. 25, 2018 (FR) ..... 18 55680

(51) Int. Cl.
*F01D 25/14* (2006.01)

(52) U.S. Cl.
CPC ..... *F01D 25/14* (2013.01); *F05D 2260/20* (2013.01)

(58) Field of Classification Search
CPC ..... F01D 25/14; F01D 11/24; F01D 25/12; F05D 2260/20; F05D 2260/201; F05D 2260/232
USPC ..... 415/175
See application file for complete search history.

(56) References Cited

U.S. PATENT DOCUMENTS

| | | | | |
|---|---|---|---|---|
| 4,019,320 | A * | 4/1977 | Redinger, Jr. | F01D 11/24 60/226.1 |
| 4,513,567 | A * | 4/1985 | Deveau | F01D 11/08 415/178 |
| 5,273,396 | A * | 12/1993 | Albrecht | F01D 11/24 415/115 |
| 5,964,575 | A * | 10/1999 | Marey | F01D 25/12 415/115 |
| 6,149,074 | A | 11/2000 | Friedel et al. | |
| 6,666,645 | B1 * | 12/2003 | Arilla | F01D 11/24 415/116 |

(Continued)

FOREIGN PATENT DOCUMENTS

| | | |
|---|---|---|
| EP | 1914392 A2 | 4/2008 |
| EP | 2236772 A2 | 10/2010 |
| FR | 2972760 B1 | 10/2015 |

OTHER PUBLICATIONS

Search Report issued in French Patent Application No. 18 55680 dated Feb. 12, 2019.

*Primary Examiner* — J. Todd Newton, Esq.
(74) *Attorney, Agent, or Firm* — Pearne & Gordon LLP

(57) ABSTRACT

The thermal shrinkage of a casing (2) to regulate as best as possible the internal play between the rotor and the stator is carried out by a ring (4) fixed onto the skin (2) rather than by a circular ramp at a distance therefrom. The ring (4) comprises, between a collection box (8) and the skin (2), a foraminous plate (7), placed on an opening of the box (8) parallel to the skin (2) and at a short distance, in order to impose invariable and known ventilation conditions.

7 Claims, 3 Drawing Sheets

(56) References Cited

U.S. PATENT DOCUMENTS

| | | | | |
|---|---|---|---|---|
| 6,896,038 | B2 * | 5/2005 | Arilla | F01D 25/12 165/47 |
| 8,801,370 | B2 * | 8/2014 | Erickson | F01D 11/24 415/173.1 |
| 8,826,668 | B2 * | 9/2014 | Lee | F01D 9/023 60/755 |
| 9,341,074 | B2 * | 5/2016 | Schimmels | F01D 25/12 |
| 2004/0258517 | A1 * | 12/2004 | Naik | F01D 11/127 415/116 |
| 2008/0206042 | A1 * | 8/2008 | Lee | F01D 5/143 415/116 |

* cited by examiner

DEVICE FOR COOLING A TURBOMACHINE CASING

The subject matter of the invention is a device for cooling a turbomachine casing by a flow of gas.

A widely employed method for regulating play in turbomachines, between the fixed and moving blades on the one hand, the rotor and the stator to which they are fixed on the other hand, consists in blowing a flow of cool gas onto the casing of the stator to produce a thermal shrinkage of its diameter. The flow is generally a small part of the flow of gases of the vein of the turbomachine, that is drawn from the compressors where the gas is at high pressure and still cool, that is left to circulate in ducts running along the vein and which is blown onto the much hotter turbines of the machine. The device traditionally comprises annular ramps surrounding the casing of the stator at a distance therefrom and provided with blowing apertures directed towards the casing. The document U.S. Pat. No. 6,149,074 A describes such a cooling device.

A drawback of this device is a lack of precision. The position of the ramp cannot always be maintained optimal on account of deformations, in particular differential thermal expansions due to different heatings, undergone by the machine during operation and the manufacturing tolerances of the blowing device comprising the ramps. These deformations and differential expansions may amount to displacing the ramps not just in the axial direction but also in the radial direction of the casing, especially since it is generally conical. The ramps may thus be located beside spots of the casing that were supposed to undergo blowing (normally the most rigid parts, around circular ribs that stiffen it, and which correctly determined these dimensions), and their distance to the casing can also be maladjusted, and even disappear in certain situations. Yet, a very high positioning precision is necessary to obtain a good quality of regulation of the play in contemporary engines, and positioning errors or displacements of the order of a millimetre can compromise the blowing quality. And if the casing enters into contact with the ramps, they can burst if it expands more.

The drawbacks of positioning errors in the mounting of the device on the casing or during operation may be reduced if the ramps are joined to the casing by connecting devices, instead of being completely separated therefrom in the aforementioned patent, but the deformations and differential thermal expansions then considerably constrain the assembly, and ruptures are also possible.

The maintaining of the cooling ramps by blowing at a clearly defined position, not just axial but also radial, with respect to the casing which undergoes the blowing of air is thus not resolved in a satisfactory manner today.

A device in which the ramps are assembled to the casing is the subject matter of the document EP 2236772 A2. The ramps are composed of an inner plate provided with blowing apertures, an outer plate delimiting a blowing chamber with the inner plate, and an intermediate plate enabling an equalisation of the air flows to the blowing apertures. These plates are provided with superimposed edges and screwed to maintaining lugs on the casing. The structure is relatively complex and positioning defects, sufficiently important in this field where very great precision is desired, risk appearing in the absence of particular mounting precautions.

It is to obviate this drawback of imprecision of cooling that the invention has been designed. In a general form, it relates to a device for cooling a turbomachine revolving casing by a flow of gas, comprising: a plate surrounding a circular band of the casing, having edges fixed to the casing and a main foraminous part parallel to the casing, the plate and the casing delimiting a gas blowing chamber equipped with discharge openings; a collection box surrounding the plate, and delimiting with the plate a gas distribution chamber while covering the main part of the plate; a gas supply capacity at a distance from the box; and at least one connecting duct connecting the capacity to the box; and the device is characterised in that the position of the plate on the casing is ensured by reliefs projecting from the latter, to serve as supports or stops for the edges of the plate; and that the reliefs procure a stop in the axial direction of the casing for a first of the edges of the plate and a support in the radial direction of the casing for a second of the edges of the plate.

The invention is thus mainly based on the linking to the casing of the end of the blowing device, that is to say the plate through which the gas is blown, which is parallel to the casing and maintained at a constant and clearly determined distance from the casing, thanks to the two stop supports obtained in perpendicular directions. The geometric blowing conditions thus remain uniform whatever the operating changes of the machine and the deformations undergone by the different parts, which do not affect this more or less non-deformable junction of the casing and the end of the blowing device.

The projecting reliefs on the casing may be provided with discharge openings.

In a preferred alternative embodiment, the collection box comprises edges respectively parallel to the edges of the plate and laid thereon; this arrangement, especially if the plate comprises a first essentially flat edge and a second edge essentially perpendicular to the first edge, makes it possible to assemble easily the collection box to the plate.

According to a preferred arrangement, the connector is bent and sliding through a wall of the box, a wall of the capacity or both, which makes it possible to compensate differential expansions in the directions of the sliding movement, or potentially any direction.

Another aspect of the invention is a turbomachine comprising such a cooling device, the plate then advantageously being able to be situated around a portion of the casing which is provided with a circular rib. The cooling device may further comprise a plurality of plates and collection boxes respectively associated with the plates, the plates and boxes form rings succeeding one another around the casing in the axial direction of the casing.

The different aspects, characteristics and advantages of the invention will now be described in detail in relation to the following figures, which represent a preferred embodiment thereof, given for purely illustrative purposes:

Figure 6:
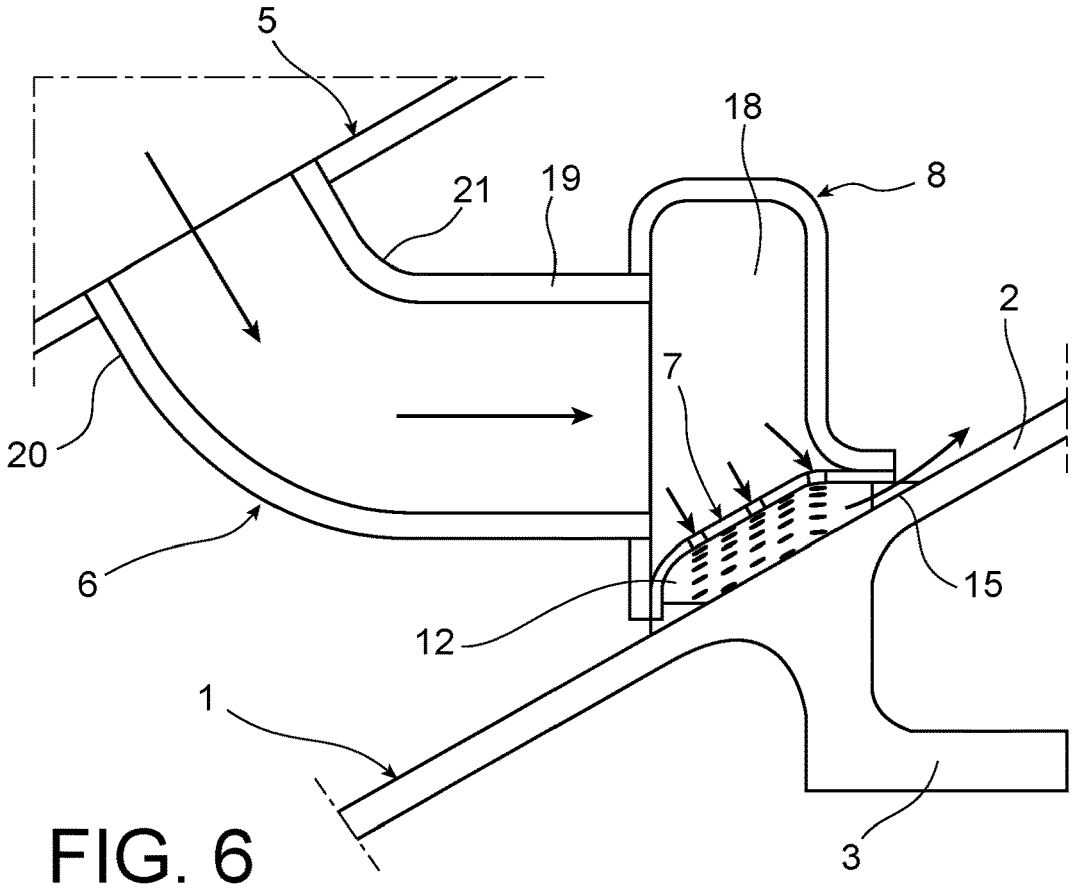

and FIG. 6 illustrates the blowing flow.

Figure 1:
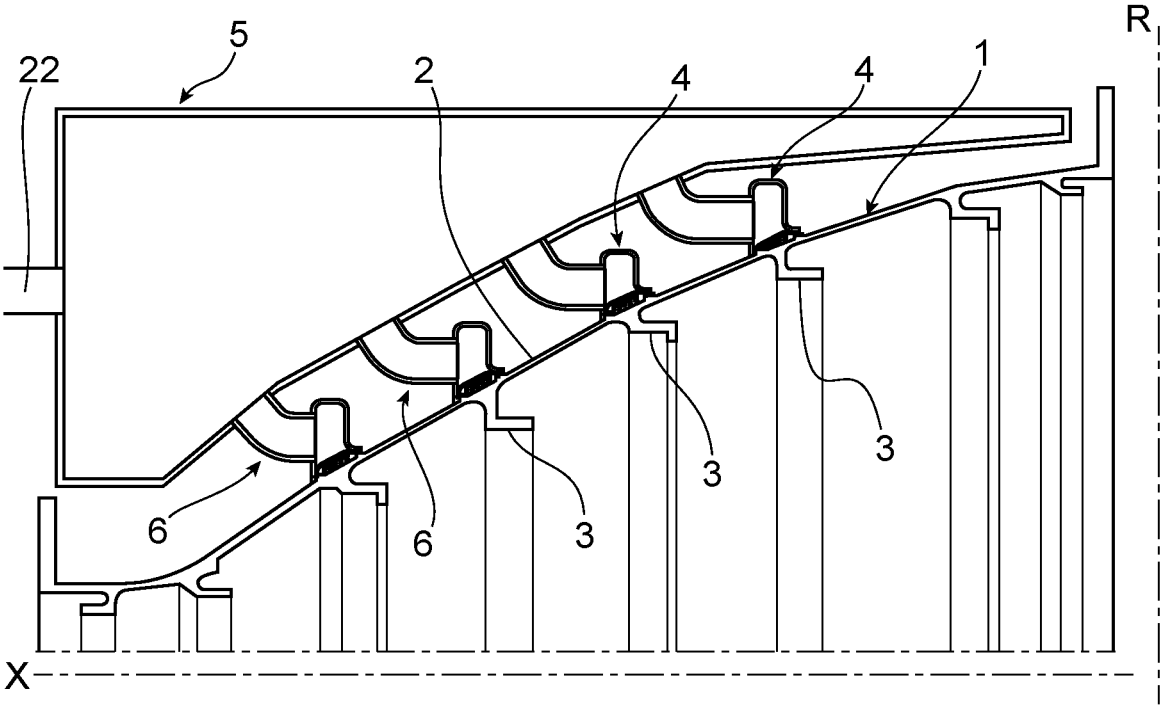
FIG. 1 is an overall view of the device in longitudinal section of the machine.

A general view of the device and of its environment is given in FIG. 1. A turbomachine turbine comprises a casing 1 around an axial direction X. The casing 1 comprises a skin 2 of conical shape regularly reinforced by circular ribs 3 and which thus define more rigid annular portions of the casing 1. A cooling device comprises rings 4 surrounding the casing 1, pressing against circular bands of the skin 2 and preferably mounted in front of the ribs 3. The rings 4 are connected to a cool gas capacity, here an air supply box 5, which extends to some distance therefrom, by connectors 6 having a bent shape.

Figure 2:
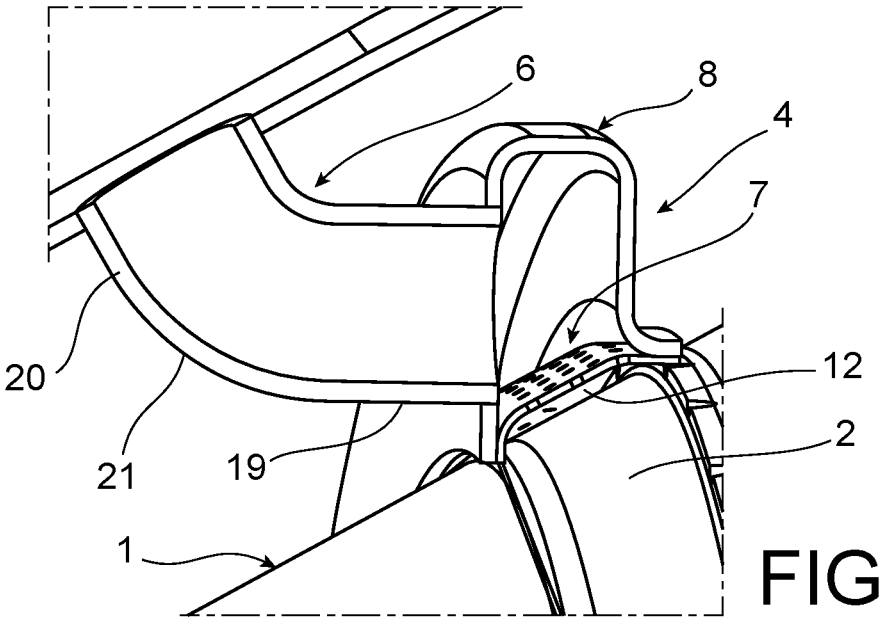
FIG. 2 is an enlargement of a unit of the device.
Figure 3:
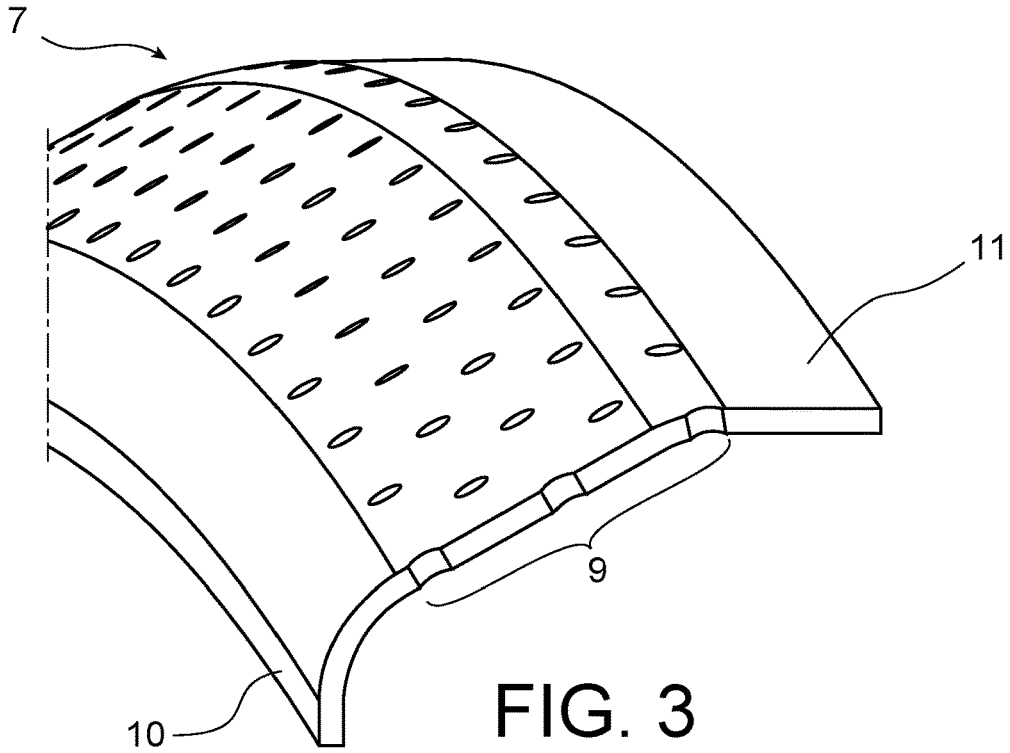
FIG. 3 illustrates the foraminous plate.
Figure 4:
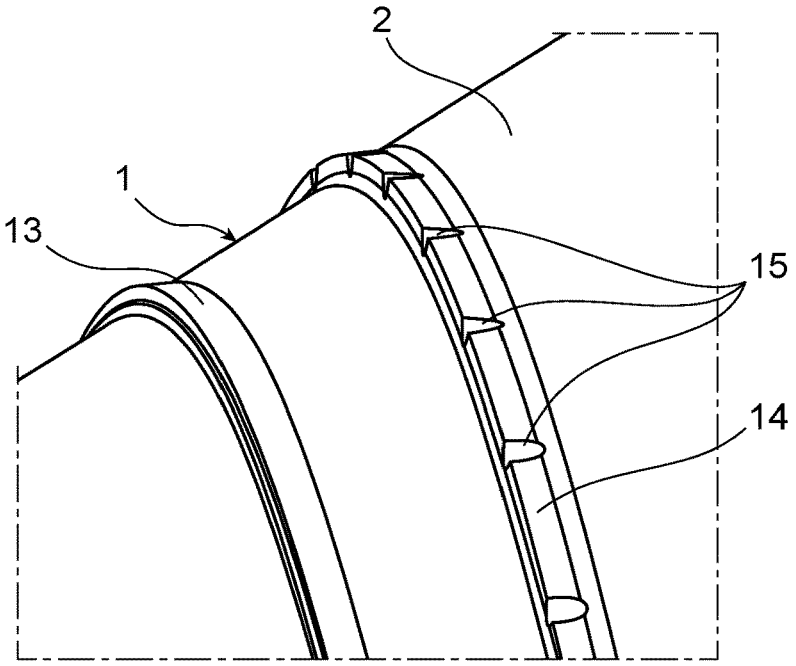
FIG. 4 illustrates the casing.
Figure 5:
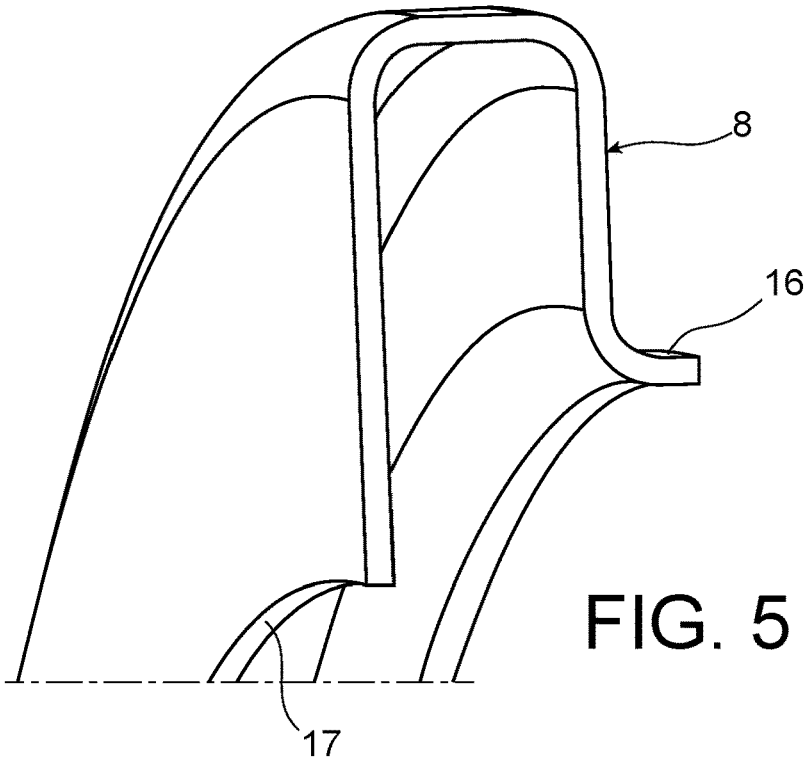
FIG. 5 illustrates the collection box.

FIG. 2 represents in detail one of the rings 4 of the device. It comprises a plate 7 of annular and conical shape, unitary in the axial direction X (potentially composed of angular sectors assembled together) laid on the skin 2 while being mounted around it and a collection box 8 covering the plate 7. FIG. 3 shows that the plate 7 comprises a main foraminous part 9, (traversed by multiple piercings) and two lateral edges 10 and 11. The plate 7 has the same conicity as the portion of the skin 2 on which it extends, such that the main part 9 is parallel to the skin 2 and separated therefrom by a blowing chamber 12 of a constant depth of several millimetres (for example 2 millimetres). It is assumed to remain rigid during assembly and operation, to maintain this depth invariable and uniform over the whole extent of the blowing chamber 12. A first lateral edge 10 is essentially flat and extends parallel to the axial direction X, whereas the second lateral edge 11 (at a larger diameter of the plate 7) is essentially cylindrical. The skin 2 (FIG. 4) is provided with two rigid reliefs 13 and 14, annular and projecting in the form of ribs, intended to receive respectively the lateral edges 10 and 11 to establish support or stop states. The first lateral edge 10 abuts against a lateral face of the relief 13 which is flat and oriented in the axial direction X, whereas the second lateral edge 11 presses against an outer face, cylindrical and of same diameter as it and oriented in the radial direction R, of the other relief 14. The latter is provided with discharge slots 15 regularly distributed on its circumference to enable the discharge from the blowing chamber 12. The collection box 8 is also of annular shape and comprises (FIG. 5) a first flat lateral edge 16 perpendicular to the axial direction X and a second lateral edge 17, opposite, directed in this axial direction X and cylindrical or slightly conical. The lateral edges 16 and 17 respectively have the same directions as the lateral edges 10 and 11 of the plate 7, and they can be laid thereon and fixed thereto by brazing, welding or otherwise. The lateral edges 10 and 11 of the plate 7 are similarly fixed to the reliefs 13 and 14 by brazing, welding or otherwise. The supports or stops in directions essentially perpendicular between the edges 10 and 11 of the plate 7 on the one hand, the reliefs 13 and 14 or the edges 16 and 17 of the collection box on the other hand, offer a simple assembly to establish and which is little constrained mechanically. The collection box 8 is furthermore formed of a continuous plate between the lateral edges 16 and 17, which is curved outwards in the radial direction R and opens only on the inner radial side, at the spot where the collection box 8 covers the main part 9 of the plate 7. The latter thus separates the blowing chamber 12 from a distribution chamber 18 situated radially outside thereof and delimited by the collection box 8.

The wall of the collection box 8 is however pierced at the spot of the connector 6. This passes through it via an axial branch 19 and connects to the supply box 5 while passing through its wall via another oblique branch 20 and separated from the preceding by a bend 21. It is advantageous that the ends of the branches 19 and 20 penetrate into the collection box 8 and the supply box 5 by junctions which make it possible to slide through their walls, in order to accommodate the device to variations in positions, due for example to thermal expansions in the machine, in particular between the casing 1 and the supply box 5.

A single connector 6 has been represented between the supply box 5 and each of the rings 4. Several connectors 6 could be provided for each of the rings 4, distributed around their circumference. It would then be advised to compartmentalise the inside of the collection boxes 8 by partitions, in order to ensure equal flows therein. The supply box 5, common to all the connectors 6, is connected to the compressor of the machine, or potentially to another compressed air source, by a pipe 22 that has only been sketched here.

In operation (FIG. 6), compressed air drawn from the compressors arrives in the supply box 5 via the pipe 22, then is distributed through the connectors 6 into the collection boxes 8 and is spread out in the angular direction in their distribution chambers 18, then crosses the plates 7 through their piercings to enter into the blowing chambers and lap against the skin 2 at the spot of the stiffeners 3, before being discharged to the outside through the slots 15. The uniform depth of the blowing chambers 12 guarantees that the air flows lap against each portion of the skin 2 in an invariable manner, which makes it possible to anticipate the thermal shrinkages that are imposed with good precision. The value of the flow rate may conventionally be regulated by a valve placed for example on the pipe 22.

The invention claimed is:

1. A device for cooling a turbomachine revolving casing by a flow of gas, comprising:

a plate surrounding a circular band of the casing, the plate having plate edges fixed to the casing and a main part which is foraminous and parallel to the casing, the plate and the casing delimiting a gas blowing chamber provided with discharge openings;

a collection box surrounding the plate, the collection box comprising and extending between two lateral edges and delimiting with the plate a gas distribution chamber while covering the main part;

a cooling gas supply capacity at a distance from the collection box;

a connecting duct connecting the capacity to the collection box, the casing comprising two projecting reliefs which support the plate edges, wherein the main part is situated around a circular rib comprised in the casing and present between the two projecting reliefs, a first of the two projecting reliefs procures a stop in an axial direction of the casing for a first of the plate edges, and a second of the two projecting reliefs procures a stop in a radial direction of the casing for a second of the plate edges, and said lateral edges are respectively fixed to the plate edges, and each of the lateral edges extends in a same direction as the plate edge to which it is fixed.

2. The device according to the claim 1, wherein the plate edges have faces respectively contacting the two projecting reliefs which are perpendicular to each other, a first of the lateral edges is flat and a second of the lateral edges is either cylindrical or conical.

3. The device according to claim 1, wherein the lateral edges are respectively laid on the plate edges.

4. The device according to claim 3, wherein at least one of the two projecting reliefs is provided with discharge openings.

5. The device according to claim 1, wherein the connecting duct is bent and able to slide through at least one of a wall of the collection box and a wall of the capacity.

6. A turbomachine comprising the device according to claim 1.

7. A turbomachine comprising a plurality of cooling devices according to claim 1, said cooling devices forming rings succeeding one another around a casing of the turbomachine in an axial direction of the casing.

* * * * *